United States Patent [19]

Giselsson

[11] Patent Number: 4,848,841

[45] Date of Patent: Jul. 18, 1989

[54] SITTING DEVICE

[75] Inventor: Jan. R. E. Giselsson, Hannabad, Sweden

[73] Assignee: Hoganasmobler AB, Hoganas, Sweden

[21] Appl. No.: 215,970

[22] Filed: Jul. 7, 1988

[51] Int. Cl.[4] ..... A47C 7/50

[52] U.S. Cl. ..... 297/423; 297/316; 297/429

[58] Field of Search ..... 297/423, 68, 106, 195, 297/429, 436, 433

[56] References Cited

U.S. PATENT DOCUMENTS

| | | | |
|---|---|---|---|
| 4,328,991 | 5/1982 | Mengshoel et al. . | |
| 4,377,309 | 3/1983 | Mengshoel . | |
| 4,621,863 | 11/1986 | Jackson et al. | 297/423 X |
| 4,650,249 | 3/1987 | Serber . | |
| 4,736,982 | 4/1988 | Hwang | 297/316 X |
| 4,765,684 | 8/1988 | Kuatheim et al. | 297/429 |

FOREIGN PATENT DOCUMENTS

| | | | |
|---|---|---|---|
| 961755 | 1/1975 | Canada | 297/423 |
| 153913 | 3/1986 | Norway . | |

*Primary Examiner*—Kenneth J. Dorner
*Assistant Examiner*—Laurie K. Crammer

[57] ABSTRACT

A sitting device, adapted to be used in two different sitting postures comprising a main frame, a seat pivotally mounted on said main frame and a separate knee support, which is pivotally mounted in one end each of a pair of supporting arms, which have their other ends pivotally mounted in links of a link system, said links being arranged in pairs and attached to the frame of the sitting device pivotable in a vertical plane, one pair of the links being prolonged by an arm, which extends between the frame and the seat.

3 Claims, 1 Drawing Sheet

SITTING DEVICE

BACKGROUND OF THE INVENTION

The present invention relates to a sitting device, adapted to be used in two different sitting postures, viz. on one hand normal sitting posture, in which one is sitting on a substantially horizontal seat with the soles of the feet against the floor, and on the second hand a kneeling-like sitting posture, in which one is sitting on a forwardly sloping seat and rests the lower parts of the legs and/or the knees against a separate knee support, which is pivotally mounted in one end each of a pair of supporting arms, which have their other ends pivotally mounted in links of a link system, said links being arranged in pairs and attached to the frame of the sitting device pivotable in a vertical plane for displacement of the knee support between a normal position below the seat and an advanced position in front of and below the seat.

OBJECT OF THE INVENTION

Doctors, physiotherapists and corresponding therapists recommend relative frequent changes of sitting posture in case of a pain the back, but also as preventive means frequent changes of the sitting posture are recommendaable. A difficulty is then that one needs two chirs to change between, snd it is felt very inconvenient in the work to move and change chairs.

It is therefore an object of this invention to provide a sitting device, which obviates the above disadvantage and will allow change of sitting posture on one and the same chair.

SUMMARY OF THE INVENTION

The sitting device according to the preferred embodiment of the present invention is characterized in that the links have the form of a link parallelogram with one pair of the links prolonged by means of an arm, which extends between the frame of the sitting device and the front portion of the seat, whereby the seat at forward and backward displacement of the knee support will move backwards and forwards respectively.

According to further features of the sitting device the seat is in its rear portion pivotally mounted in one end of an arm, which in its other end is pivotably mounted in the main frame of the sitting device and which in the horizontal position of the seat extends obliquely downwards and rearwards, but which when the seat is moved backwards is rised and lifts the rear portion of the seat. The sitting device is also preferably provided with a biasing means urging the knee support in the forward direction and the set in the rearward direction and also with a locking means for locking the knee support in its normal position and its advanced position respectively.

DETAILED DESCRIPTION OF SPECIFIC EMBODIMENTS

Figure 1:
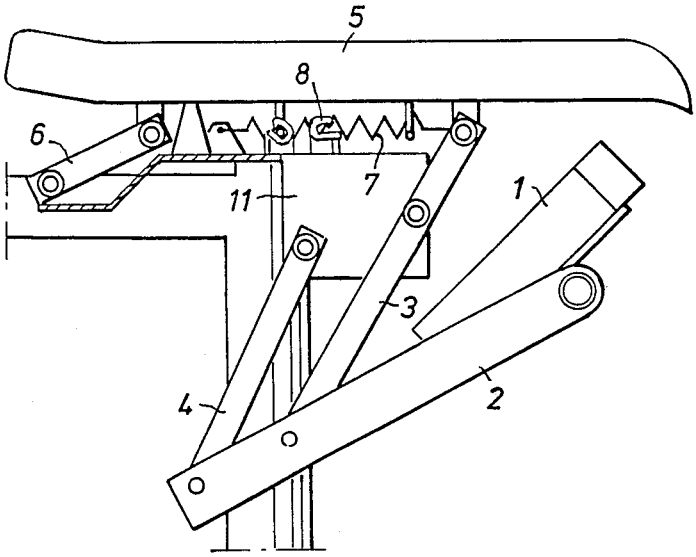
FIG. 1 is schematic side view of a sitting device according to the invention with the knee support in its normal position below the set of the sitting device.
Figure 2:
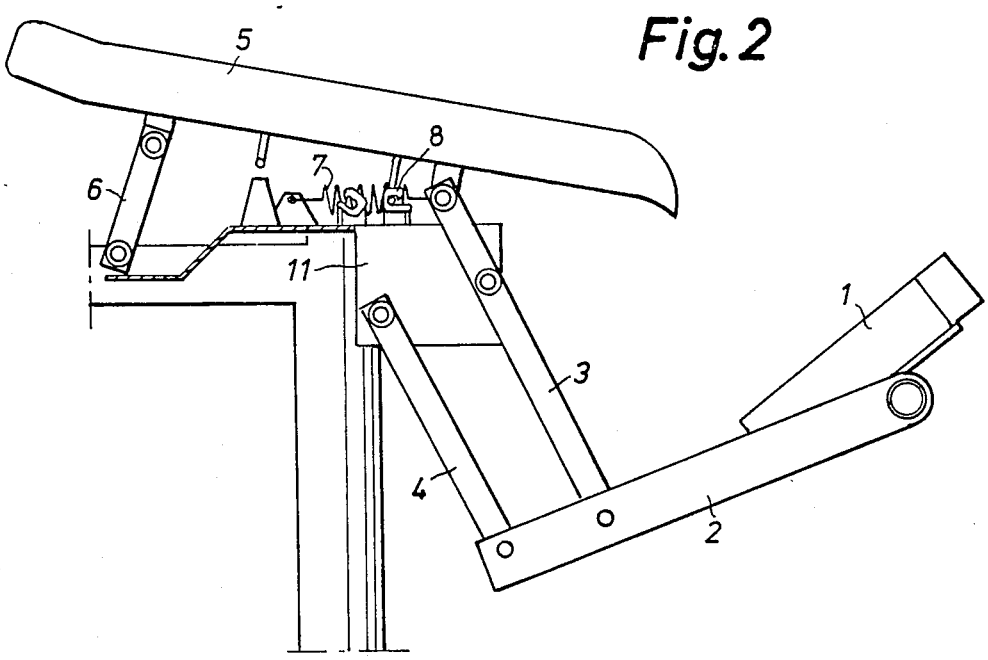
FIG. 2 is a view similar to that in FIG. 1, showing the knee support in its forward position and the seat moved backwards with its rear portion lifted.

In FIGS. 1–2 is shown a sitting device having a knee support 1, which is tiltably mounted in one end each of a pair of supporting arms 2, which in their respective other ends are journalled in the lower ends of pairs of parallel links 3, 4, the upper neds of which are pivotably mounted in a main frame 11 of the sitting device.

Above the frame there is a seat 5, which near its front end is journalled in pivot arms, which are extensions of the front links 3. Near its rear end the seat is pivotally mounted in one end of a seat support arm 6, which extends obliquely rearwards and downwrds, and which in its other end is journalled in the main frame of the sitting device.

The links 3 and 4 form with the supporting arms 2 and the main frames 11 of the sitting device a link system allowing the knee support 1 to be moved from the normal position below the set, shown in FIG. 1, to an advanced position in front of the seat, as shown in FIG. 2. At the same time the extensions of the front links 3 are moved and entrain seat in the rear direction, rising the seat support arm 6 while lifting the rear portion of the seat. The sitting device is then adapted for a kneeling-like sitting posture. Due to the rearward movement of the seat, when it is adjusted from normal sitting position to the kneelingly sitting position, the body and the head of a person sitting on the device will remain in substantially the same position during the adjustment, which is of importance when the sitting person is working at a computer terminal, is doing fine mechanical work, is on guard duty, etc.

By means of locking means 8 the seat 5 can be locked in both positions. A biasing means 7, which may be a helical tension spring, a gas spring or the like, has its one end attached to the seat and its other end to the main frame 11 and tends to urge the seat in the rearward direction. When the locking means 8 is released and placed in the position shown in FIG. 1, the sitting device will be adjusted to the kneeling-like sitting position as shown in FIG. 2 and locked in said position. If the locking means is released in this position and the seat is pressed down manually or by sitting on the same, the seat is pressed against the force of the biasing means 7 to the position of normal sitting posture, and the knee support is retracted below the seat.

While the invention has been described above in conjunction with a preferred embodiment thereof, it is obvious that modifications and changes may be made by those skilled in the art without departing from the spirit and scope of the invention.

The invention claimed is:

1. A sitting device adapted to be used in two different sitting posutres, viz. on one hand in normal sitting posture and on the second hand a kneeling-like sitting posture, comprising a main frame, a seat pivotably mounted in said frame and pivotable between a substantially horizontal forwardly translated position, in which one can sit in the normal sitting posture on the sitting device with the soles of the feet against the floor, and a forwardly sloping rearwardly translated position, in which one can sit in the kneeling-like sitting posture; a knee support, which is pivotably attached to one end of a pair of supporting arms, which have their other ends pivotably attached to links of link system, said links being arranged in pairs and attached to the frame of the sitting device pivotable in a vertical plane for displacement of the knee support between a normal position below the seat and an advanced position in front of and below the seat, said links forming a link parallelogram, one pair of the links being prolonged by means of an arm, which extends between the frame of the sitting device and the front portion of the set, whereby the seat due to displacement from the advanced position to the normal position of the knee support will move backwards and forwards respectively.

2. A sitting device as claimed in claim 1, wherein the seat in its rear portion is pivotally attached to one end of an arm the other end of the arm being pivotally mounted to the main frame of the sitting device whereby in the horizontal position of the set forwardly translated the arm extends obliquely downwards and rearwards, but in the forwardly sloping rearwrdly translated position of the seat, the arm is raised upwardly such that it lifts the rear portion of the seat.

3. A sitting device as claimed in claim 1, comprising a biasing means tending to urge the knee support to the advanced position and the seat in the forwardly sloping rearwardly translated position, and a locking means for locking the knee support in its normal position and its advanced position respectively.

* * * * *